US011834815B2

(12) United States Patent
Xie et al.

(10) Patent No.: US 11,834,815 B2
(45) Date of Patent: Dec. 5, 2023

(54) FAUCET WITH HIDDEN WATER OUTLET MODULE

(71) Applicant: Purity (Xiamen) Sanitary Ware Co., LTD, Xiamen (CN)

(72) Inventors: Pawel Xie, Xiamen (CN); Cewen Yang, Xiamen (CN); MingQiang Yan, Xiamen (CN)

(73) Assignee: PURITY (XIAMEN) SANITARY WARE CO., LTD, Xiamen (CN)

( * ) Notice: Subject to any disclaimer, the term of this patent is extended or adjusted under 35 U.S.C. 154(b) by 191 days.

(21) Appl. No.: 17/647,172

(22) Filed: Jan. 6, 2022

(65) Prior Publication Data

US 2022/0127829 A1 Apr. 28, 2022

(30) Foreign Application Priority Data

Sep. 15, 2021 (CN) ..... 202111082382.3

(51) Int. Cl.
*E03C 1/04* (2006.01)

(52) U.S. Cl.
CPC ..... *E03C 1/0404* (2013.01)

(58) Field of Classification Search
CPC ..... E03C 1/0404
USPC ..... 4/675–678, 567, 615; 239/24–27, 447
See application file for complete search history.

(56) References Cited

U.S. PATENT DOCUMENTS

2010/0326553 A1 12/2010 Kacik et al.
2012/0267455 A1 10/2012 Hansen
2020/0041012 A1 2/2020 Chang et al.
2021/0138488 A1* 5/2021 Lin ..... B05B 1/326

FOREIGN PATENT DOCUMENTS

CN 211398705 U * 9/2020
CN 111927981 A * 11/2020 ..... E03C 1/0404

* cited by examiner

*Primary Examiner* — Tuan N Nguyen
(74) *Attorney, Agent, or Firm* — Zhigang Ma

(57) ABSTRACT

The present disclosure discloses a faucet with a hidden water outlet module. The faucet with the hidden water outlet module provided by the present disclosure has a simple structure and reasonable design, is easy to realize, and solves the problems that a functional water outlet (a mouthwash outlet) of the existing faucet is easy to contaminate and the hygiene is poor.

5 Claims, 3 Drawing Sheets

FAUCET WITH HIDDEN WATER OUTLET MODULE

TECHNICAL FIELD

The present disclosure relates to the bathroom accessory industry, in particular to a faucet with a hidden water outlet module.

BACKGROUND ART

At present, faucets with gargle, spray, and face washing functions have been favored by consumers, and many such products are also launched on the market. Most of them have a water outlet (the water outlet that sprays mouthwash is taken as an example) in a circumferential wall of a faucet body, which is controlled by a switch to achieve a function of spraying the mouthwash. Although the above-mentioned method can realize the functions of spraying mouthwash, atomized water, and water for washing face, there are still certain shortcomings, specifically as follows: (1) poor hygiene: the mouthwash function is taken as an example; the water outlet for spraying the mouthwash is open; when the faucet regularly provides water for washing items or others, sewage or residual water will flow into the opened water outlet, which will contaminate the mouthwash contained in the oral cavity and easily leave dirt at the mouthwash outlet, polluting the water source; (2) extreme inconvenience of use: this faucet cannot be used until the switch is ceaselessly pressed, and it is hard to open the mouthwash outlet under the effect of water pressure.

In summary, the existing faucets with functional modules of mouthwash, atomized water, and water for washing face need to be further improved.

SUMMARY

The present disclosure aims to solve the existing problems and provide a faucet with a hidden water outlet module, which has a simple structure and reasonable design, is easy to realize, and solves the problems that a functional module water outlet set on the existing faucet is easy to contaminate and the hygiene is poor.

In order to achieve the foregoing objective, the present disclosure adopts the following technical solutions.

A faucet with a hidden water outlet module includes a faucet body, a water inlet path and at least first and second water outlet paths being arranged inside the faucet body;

a hidden water outlet assembly which includes a movable rod and a first elastic member, the movable rod moving in an axial direction of the faucet body and having an extending and retracting displacement with respect to the faucet body, a water passing path and a water outlet being formed on the movable rod, one end of the water passing path being led to the first water outlet path and the other end being communicated with the water outlet, and two ends of the first elastic member respectively acting on the faucet body and the movable rod;

a switching assembly which is arranged inside the faucet body and is used for switching the water inlet path to be led to any water outlet path;

in particular, an end of the movable rod close to the water inlet path is formed into a pressure bearing surface, and the pressure bearing surface presses against the movable rod under the effect of a water pressure to move in the axial direction of the movable rod and compresses the first elastic member, so that the water outlet on the movable rod is exposed from the faucet body.

Further, the switching assembly includes a switching body and a second elastic member; the switching body is perpendicular to an axis of the faucet body and is used for blocking any water outlet path; two ends of the second elastic member respectively act on an end part of the switching body and the faucet body, so that when the switching body loses a loading force, the water inlet path is switched to be led to the second water outlet path.

Further, the switching assembly further includes a pressing structure used for applying the loading force to the switching body; the pressing structure includes a cover body assembled with the faucet body and forming a lever swing structure; one side of the cover body is hinged to one end of the switching body; and in particular, the cover body is pressed to form lever swinging by taking a connection between the cover body and the faucet body as a strut, and then is linked with the switching body to move, so that the water inlet path is led to any water outlet path.

Further, the movable rod includes a water outlet part and a water inlet part which are disposed in a steplike manner and are connected into a whole; the pressure bearing surface is formed on the water inlet part; and a water passing gap is formed between the water outlet part and the faucet body.

Further, a step slot is formed in the water inlet part; and a slot bottom of the step slot and an outer surface of the water inlet part cooperate with each other to form the pressure bearing surface.

Compared to the existing art, the technical solutions of the present disclosure achieve the beneficial effects below:

(1) The faucet with the hidden water outlet module provided by the present disclosure has a simple structure and reasonable design, is easy to realize, and solves the problems that a functional module water outlet set on the existing faucet is easy to contaminate and the hygiene is poor. One hidden water outlet assembly (which is defined as a functional module water outlet assembly for spraying mouthwash, water for washing face, water for rinsing teeth, water for washing teeth, and atomized water) is arranged inside the faucet of the present disclosure. The hidden water outlet assembly is disposed in an extending and retracting manner with respect to the faucet body. When the switching body is switched to the first water outlet path to provide water, water flow impacts the pressure bearing surface of the movable rod, so as to push the movable rod out of the faucet body and enable a mouthwash outlet originally hidden in the faucet body to be exposed from the faucet body, and water is provided (mouthwash flows out). This structural design is ingenious. The water flow is used as a power source, so no external or hand drive force is needed. Furthermore, the faucet has a function of hiding the water outlet, which avoids sewage from directly polluting the water outlet and achieves good hygiene. More importantly, by means of the hidden design, the movable rod can be functionally embodied more visually and accurately. When the movable rod protrudes, the mouthwash function is enabled. This is more favored and loved by customers.

(2) In the present disclosure, the switching assembly includes the switching body and the second elastic member, and the second elastic body is arranged between the end part of the switching body and the faucet body. This design realizes that after a switch valve core of the faucet is closed, the switching body is automatically reset, under the action of the second elastic member, to the second water outlet path to regularly provide water; due to the automatic reset function, a user (customer) cannot operate it by mistake; the number of times of operations is reduced; and the experience is better.

(3) The present disclosure further includes one pressing structure. The pressing structure is connected to the faucet body by the lever swing structure. This setting realizes that when the mouthwash function is enabled, function switching can be realized, so after using the mouthwash function at each time, the user does not need to remotely close the switch valve core of the faucet to switch the mouthwash function to the regular water path, and the mouthwash function and the regular water providing function can be easily switched by means of the pressing structure. The faucet has the advantages of simple and convenient switching, fastness, and the like.

(4) In the present disclosure, the water passing gap is formed between the water outlet part and the faucet body, so that residual water can be discharged through the water passing gap, and the reduction of the hygienic standard due to the residual water is avoided.

(5) In the present disclosure, by means of the step slot, the water potential can be enhanced, so as to increase the driving force to overcome the acting force of the first elastic member and ensure the extending and retracting stability of the whole movable rod with respect to the faucet body.

BRIEF DESCRIPTION OF THE DRAWINGS

Drawings described herein are used for providing further understandings of the present disclosure, and constitute one part of the present disclosure. Illustrative embodiments and descriptions thereof of the present invention are used for explaining the present disclosure, and do not constitute an improper limitation to the present disclosure. In the drawings.

DETAILED DESCRIPTION OF THE EMBODIMENTS

In order to make the technical problems, technical solutions, and beneficial effects of the present disclosure clearer, the present disclosure is further described below in detail with reference to accompanying drawings and embodiments. It should be understood that the specific embodiments described here are merely to illustrate and explain the present disclosure, and not intended to limit the present disclosure.

Figure 1:
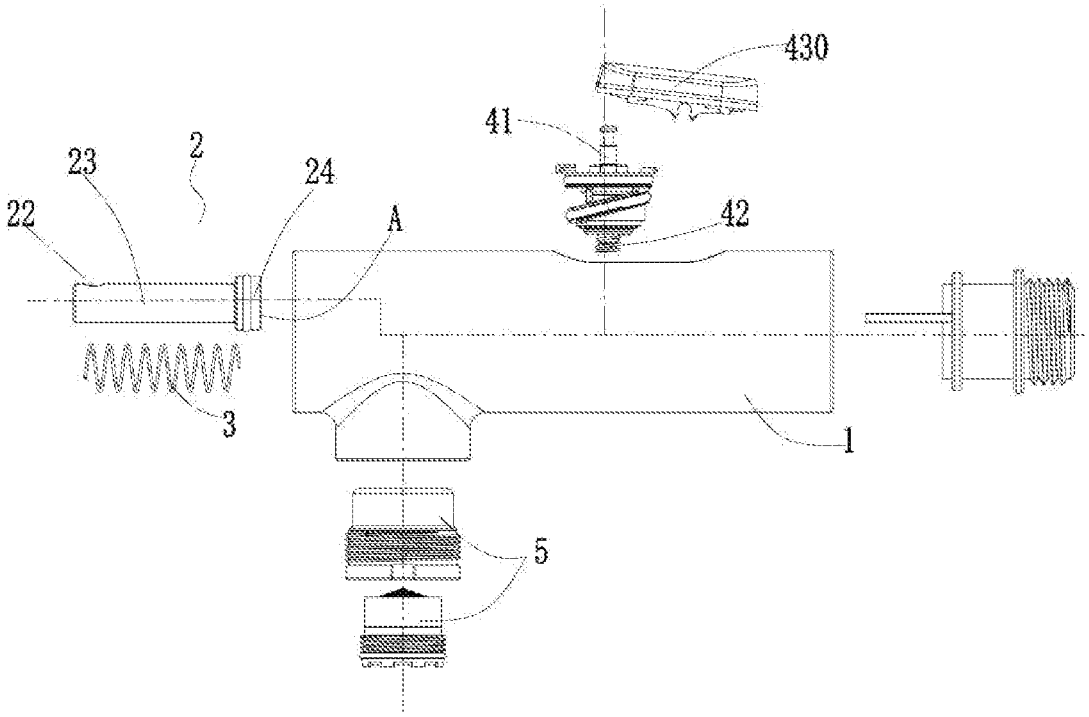
FIG. 1 is a schematic diagram of a three-dimensional exploded structure of the present invention.
Figure 2:
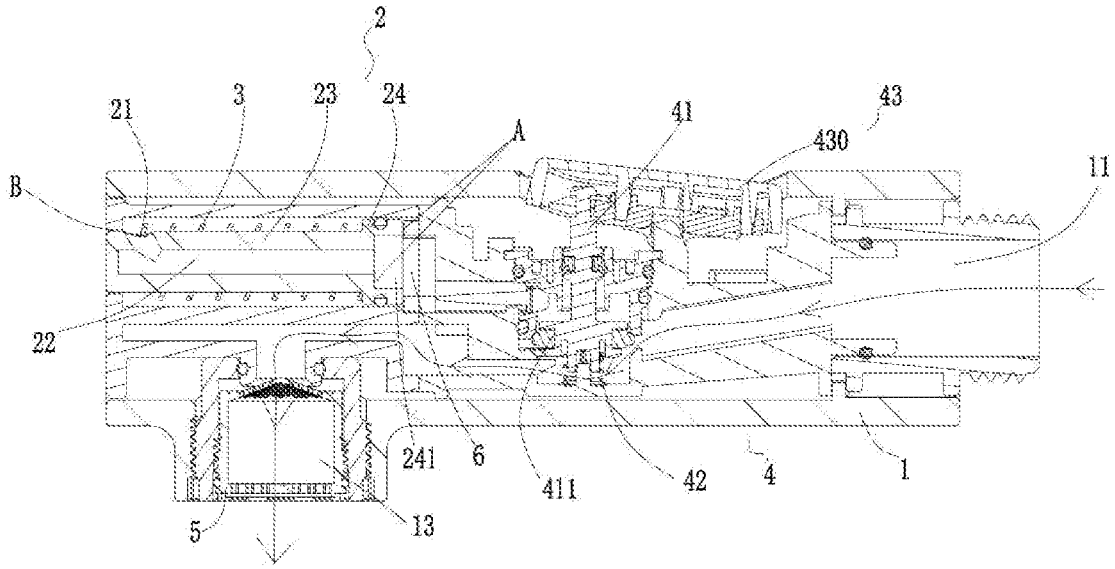
FIG. 2 is a sectional view illustrating that a regular water outlet of the faucet is opened in the present invention.
Figure 3:
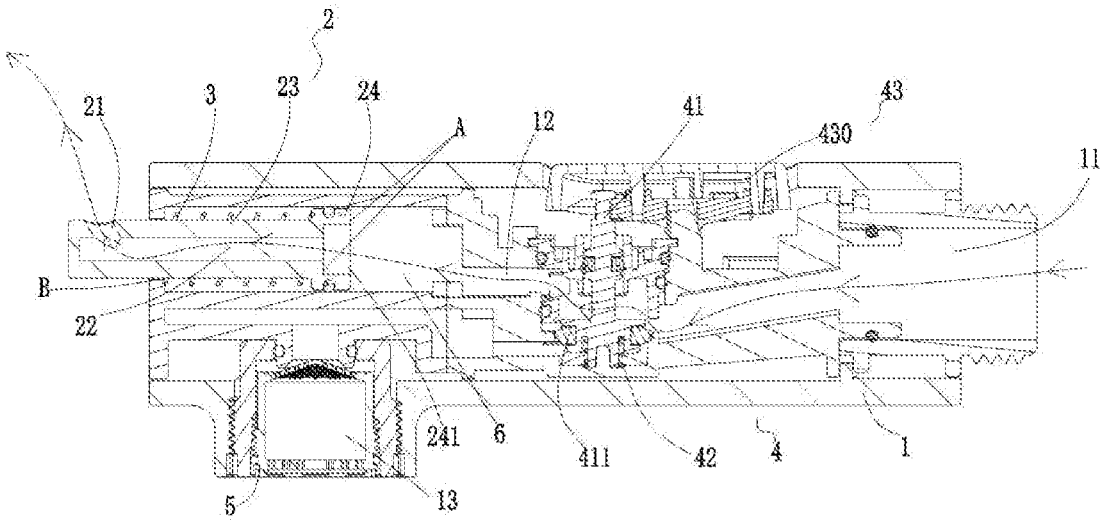
FIG. 3 is a sectional view illustrating that a functional water outlet of the faucet is opened in the present invention.

As shown in FIGS. 1, 2, and 3, in the present disclosure, a faucet with a hidden water outlet module includes a faucet body 1. A water inlet path 11 and at least first and second water outlet paths 12, 13 are arranged inside the faucet body 1.

A hidden water outlet assembly is provided, which includes a movable rod 2 and a first elastic member 3. It should be noted that the hidden water outlet assembly is defined as a water outlet assembly with functions of spraying mouthwash, water for washing face, water for rinsing teeth, water for washing teeth, spraying atomized water, and the like. That is, the faucet has the functions of spraying mouthwash, water for washing face, water for rinsing and washing teeth, and atomized water. In the embodiment of the present disclosure, the water outlet assembly with the function of spraying the mouthwash is taken as an example.

The movable rod 2 moves along the faucet body 1 (the movement here means that the movable rod 2 can move in an axial direction or a radial direction of the faucet body 1, or move in other angles, as long as an angle of a water outlet 22 on the movable rod 2 is adjusted) and extends and retracts with respect to the faucet body 1. The movable rod 2 is provided with a water passing path 21 and the water outlet 22. One end of the water passing path 21 is led to a first water outlet path 12, and the other end is communicated with the water outlet 22.

The movable rod 2 includes a water outlet part 23 and a water inlet part 24 which are disposed in a steplike manner and are connected into a whole; a pressure bearing surface A is formed on the water inlet part 24; and a water passing gap B is formed between the water outlet part 23 and the faucet body 1. One step slot 241 is formed in the water inlet part 24; and a slot bottom of the step slot 241 and an outer surface of the water inlet part 24 cooperate with each other to form the pressure bearing surface A.

Two ends of the first elastic member 3 respectively act on the faucet body 1 and the movable rod 2.

A switching assembly 4 is provided, which is arranged inside the faucet body 1 and is used for switching the water inlet path 11 to be led to any water outlet path 12, 13.

The switching assembly 4 includes a switching body 41 and a second elastic member 42.

The switching body 41 is perpendicular to an axis of the faucet body 1 and is used for blocking any water outlet path 12, 13.

Two ends of the second elastic member 42 respectively act on an end part of the switching body 41 and the faucet body 1, so that when the switching body 41 loses a loading force, the water inlet path 11 is switched to be led to the second water outlet path 13.

In particular, an end of the movable rod 2 close to the water inlet path 11 is formed into the pressure bearing surface A, and the pressure bearing surface A presses against the movable rod 2 under the effect of a water pressure to move in the axial direction of the movable rod and compresses the first elastic member 3, so that the water outlet 22 on the movable rod 2 is exposed from the faucet body 1.

More specifically, the switching assembly 4 further includes a pressing structure 43 used for applying the loading force to the switching body 41; the pressing structure 43 includes a cover body 430 assembled with the faucet body 1 and forming a lever swing structure; one side of the cover body 430 is hinged to one end of the switching body 41; and in particular, the cover body 430 is pressed to form lever swinging by taking a connection between the cover body 430 and the faucet body 1 as a strut, and then is linked with the switching body 41 to move, so that the water inlet path 11 is led to any water outlet path 12, 13.

In a specific implementation mode, as shown in FIGS. 1, 2, and 3, the faucet with the hidden water outlet module of the present disclosure mainly includes the following components: the faucet body 1, the movable rod 2, the first elastic member 3, the switching body 41, the second elastic member 42, the cover body 430, and a water outlet member 5.

During actual assembling and use, (1) the faucet body 1 is provided with the water inlet path 11 (i.e., a water inlet joint), the first and second water outlet paths 12, 13, and an accommodating cavity 6 for mounting the switching body 41, the water outlet member 5, and the movable rod 2. It should be noted that the first water outlet path 12 is led to the water outlet member 5 to regularly provide water. In the present invention, the regular water outlet direction is set into the axial direction perpendicular to the faucet body 1. Of course, the water outlet direction may be set in other angles with respect to the faucet body. (2) The movable rod 2 is steplike, thus forming the water outlet part 23 and the water inlet part 24 which are connected into a whole. After the first elastic member 3 is sleeved at a periphery of the water outlet part 23, they are arranged into the faucet body 1, and the first elastic member 3 works between the faucet body 1 and the movable rod 2. (3) The switching assembly 4 is disposed in the radial direction of the faucet body 1. Specifically, the second elastic member 42 of the switching assembly 4 is pre-assembled at an end part of the switching body 41, then the switching body 41 is arranged into the faucet body 1, and the cover body 430 is fastened into the other end part of the switching body 41. In this way, the movement of the cover body 430 can drive the switching body 41 to move in the radial direction of the faucet body 1. It should be noted that the switching body 41 is provided with a blocking part 411. The blocking part 411 is switched to block the first or second water outlet path 13 as the switching body 41 moves. (4) The cover body 430 is arranged on a peripheral wall of the faucet body 1 and forms the lever swing structure by taking the connection between the cover body 430 and the faucet body 1 as the strut.

During use, (1) in an original state (as shown in FIGS. 1 and 2), a switch valve core (not shown) of the faucet is opened; water flow flows through the switching body 41 from the water inlet path 11 of the faucet body 1, then flows out from the second water outlet path 13, and is finally sprayed out from the water outlet member 5. This is regular faucet water providing. It should be noted that under the action of the second elastic member 42, the blocking part 411 of the switching body 41 blocks the first water outlet path 12. (2) When mouthwash is needed (as shown in FIGS. 1 and 3), the cover body 430 is pressed. When the cover body 430 is stressed by the loading force, the switching body 41 moves towards the second elastic member 42, and the blocking part 411 on it blocks the second water outlet path 13, so as to open the first water outlet path 12. Water flow enters the accommodating cavity 6 for placing the movable rod 2 and the first elastic member 3 from the first water outlet path 12. At this time, the water flow pushes against the pressure bearing surface A on the water inlet part 24 of the movable rod 2. When the bearing pressure of the pressure bearing surface A is greater than the acting force of the first elastic member 3, the movable rod 2 moves in the axial direction of the faucet body 1, and the water outlet 22 of the water outlet part 23 on the movable rod 2 is exposed from the faucet body 1. Finally, the water flow is sprayed from the water outlet 22 on the movable rod 2 to provide mouthwash. It should be noted that the step slot 241 is formed at the water inlet part 24 of the movable rod 2. This step slot 241 achieves a water flow gathering effect, which realizes pressurizing and accelerating functions and provides a larger space to form the pressure bearing surface A, so as to facilitate pushing the movable rod 2 to move. (3) When the regular water outlet path needs to be used during use, only the cover body 430 needs to be pressed to enable, through the lever swing structure, the switching body 41 to move in an opposite direction. By the acting force of the second elastic member 42, switching is performed more quickly to realize the regular water providing state, without closing the distant switch valve core (not shown), and resetting is realized by the second elastic member 42. (4) When the switch valve core (not shown) is closed after use, the switch body 41 can be automatically switched to the regular water outlet path (i.e., the second water outlet path 13). Specifically, after the switch valve core (not shown) is closed, under the action of the second elastic member 42, the switching body 41 moves in the opposite direction, and the blocking part on it blocks the first water outlet path 12. At this time, there is no continuous water flow pushing against the pressure bearing surface A on the movable rod 2, and the water outlet 22 of the movable rod 2 is communicated with the atmosphere. Under the action of the first elastic member 3, the residual water in the accommodating cavity 6 flows out from the inside of the movable rod 2 to the water outlet 22, so that the movable rod 2 automatically moves towards the accommodating cavity 6 of the faucet body 1 till it is stored. The residual water in the movable rod 2 flows from the water outlet 22 into a part between the water outlet part 23 and the faucet body 1. This part of the residual water flows out from the water passing gap B formed between the water outlet part 23 and the faucet body 1 and is avoided from contaminating the movable rod 2. Finally, when the switch valve body (not shown) is closed or the second water outlet path 13 is used, the movable rod 2 is automatically reset into the faucet body 1, so as to realize a function of hiding and protecting the movable rod 2.

The faucet with the hidden water outlet module provided by the present disclosure has a simple structure and reasonable design, is easy to realize, and solves the problems that the mouthwash water outlet of the existing faucet is easy to contaminate and the hygiene is poor. One hidden water outlet assembly is arranged inside the faucet of the present disclosure. The hidden water outlet assembly is disposed in an extending and retracting manner with respect to the faucet body. When the switching body is switched to the first water outlet path to provide water, water flow impacts the pressure bearing surface of the movable rod, so as to push the movable rod out of the faucet body and enable the mouthwash outlet originally hidden in the faucet body to be exposed from the faucet body, and water is provided (mouthwash flows out). This structural design is ingenious. The water flow is used as a power source, so no external or hand driving force is needed. Furthermore, the faucet has a function of hiding the water outlet, which avoids sewage from directly polluting the water outlet and achieves good hygiene. More importantly, by means of the hidden design, the movable rod can be functionally embodied more visually and accurately. When the movable rod protrudes, the mouthwash function is enabled. This is more favored and loved by customers. In the present invention, the switching assembly includes the switching body and the second elastic member, and the second elastic body is arranged between the end part of the switching body and the faucet body. This design realizes that after a switch valve core of the faucet is closed, the switching body is automatically reset, under the action of the second elastic member, to the second water outlet path to regularly provide water; due to the automatic reset function, a user (customer) cannot operate it by mistake; the number of times of operations is reduced; and the experience is better. The present invention further includes one pressing structure. The pressing structure is connected to the faucet body by the lever swing structure. This setting realizes that when the mouthwash function is enabled, function switching can be realized, so after using the mouthwash function at each time, the user does not need to remotely close the switch valve core of the faucet to switch the mouthwash function to the regular water path, and the mouthwash function and the regular water providing function can be easily switched by means of the pressing structure. The faucet has the advantages of simple and convenient switching, fastness, and the like. In the present invention, the water passing gap is formed between the water outlet part and the faucet body, so that the residual water can be discharged through the water passing gap, and the reduction of the hygienic standard due to the residual water is avoided. In the present invention, by means of the step slot, the water potential can be enhanced, so as to increase the driving force to overcome the acting force of the first elastic member and ensure the extending and retracting stability of the whole movable rod with respect to the faucet body.

The above description shows and describes preferred embodiments of the present disclosure. As mentioned above, it should be understood that the present disclosure is not limited to the form disclosed herein and should not be regarded as the exclusion of other embodiments, but can be used for various other combinations, modifications, and environments. The present disclosure can be changed within the conceived scope of this application by means of the above teachings or technologies or knowledge in the related art. The modifications and changes made by those skilled in the art do not depart from the spirit and scope of the present disclosure, and shall all fall within the protection scope of the appended claims of the present disclosure.

What is claimed is:

1. A faucet with a hidden water outlet module, comprising a faucet body, a water inlet path and at least first and second water outlet paths being arranged inside the faucet body;

a hidden water outlet assembly which comprises a movable rod and a first elastic member, the movable rod moving in an axial direction of the faucet body and having an extending and retracting displacement with respect to the faucet body, a water passing path and a water outlet being formed on the movable rod, one end of the water passing path being led to the first water outlet path and the other end being communicated with the water outlet, and two ends of the first elastic member respectively acting on the faucet body and the movable rod;

a switching assembly which is arranged inside the faucet body and is used for switching the water inlet path to be led to any water outlet path;

wherein an end of the movable rod close to the water inlet path is formed into a pressure bearing surface, and the pressure bearing surface presses against the movable rod under the effect of a water pressure to move in the axial direction of the movable rod and compresses the first elastic member, so that the water outlet on the movable rod is exposed from the faucet body.

2. The faucet with the hidden water outlet module according to claim 1, wherein the switching assembly comprises a switching body and a second elastic member; the switching body is perpendicular to an axis of the faucet body and is used for blocking any water outlet path; two ends of the second elastic member respectively act on an end part of the switching body and the faucet body, so that when the switching body loses a loading force, the water inlet path is switched to be led to the second water outlet path.

3. The faucet with the hidden water outlet module according to claim 2, wherein the switching assembly further comprises a pressing structure used for applying the loading force to the switching body; the pressing structure comprises a cover body assembled with the faucet body and forming a lever swing structure; one side of the cover body is hinged to one end of the switching body, wherein the cover body is pressed to form lever swinging by taking a connection between the cover body and the faucet body as a strut, and then is linked with the switching body to move, so that the water inlet path is led to any water outlet path.

4. The faucet with the hidden water outlet module according to claim 1, wherein the movable rod comprises a water outlet part and a water inlet part which are disposed in a steplike manner and are connected into a whole; the pressure bearing surface is formed on the water inlet part; and a water passing gap is formed between the water outlet part and the faucet body.

5. The faucet with the hidden water outlet module according to claim 4, wherein a step slot is formed in the water inlet part; and a slot bottom of the step slot and an outer surface of the water inlet part cooperate with each other to form the pressure bearing surface.

* * * * *